US008267616B2

(12) United States Patent
McGregor

(10) Patent No.: US 8,267,616 B2
(45) Date of Patent: Sep. 18, 2012

(54) PIVOT JOINT

(75) Inventor: Duncan McGregor, Torbay (NZ)

(73) Assignee: Assa Abloy New Zealand Limited, Auckland (NZ)

( * ) Notice: Subject to any disclaimer, the term of this patent is extended or adjusted under 35 U.S.C. 154(b) by 518 days.

(21) Appl. No.: 12/308,927

(22) PCT Filed: Jul. 11, 2007

(86) PCT No.: PCT/NZ2007/000177

§ 371 (c)(1),
(2), (4) Date: Sep. 8, 2009

(87) PCT Pub. No.: WO2008/007978

PCT Pub. Date: Jan. 17, 2008

(65) Prior Publication Data

US 2010/0047009 A1 Feb. 25, 2010

(30) Foreign Application Priority Data

Jul. 12, 2006 (NZ) ..... 548458

(51) Int. Cl.
*B25G 3/20* (2006.01)

(52) U.S. Cl. ..... 403/367; 292/156

(58) Field of Classification Search ..... 403/367, 403/368, 369; 292/156, 240, 241, 242, DIG. 20, 292/DIG. 47, DIG. 64, DIG. 53, DIG. 54; 411/353, 150; 16/441, 2.1–2.5, 108–109
See application file for complete search history.

(56) References Cited

U.S. PATENT DOCUMENTS

| | | | | |
|---|---|---|---|---|
| 3,946,963 | A * | 3/1976 | Oberg | 242/246 |
| 4,436,328 | A * | 3/1984 | Chernosky | 292/67 |
| 5,219,193 | A * | 6/1993 | Piltingsrud | 292/240 |
| 6,142,541 | A * | 11/2000 | Rotondi | 292/241 |
| 6,412,834 | B1 * | 7/2002 | Waitai et al. | 292/197 |
| 6,598,910 | B2 | 7/2003 | McGregor et al. | |
| 6,802,543 | B1 * | 10/2004 | Wakefield | 292/48 |
| 6,962,024 | B1 | 11/2005 | Miller et al. | |
| 7,013,603 | B2 * | 3/2006 | Eenigenburg et al. | 49/185 |
| 7,063,361 | B1 | 6/2006 | Lawrence | |
| 7,070,215 | B2 * | 7/2006 | Kelley et al. | 292/241 |
| 7,322,620 | B1 * | 1/2008 | Lawrence | 292/242 |
| 7,490,873 | B1 * | 2/2009 | Ricke et al. | 292/5 |
| 7,510,221 | B2 * | 3/2009 | Eenigenburg et al. | 292/240 |
| 7,665,775 | B1 * | 2/2010 | Miller et al. | 292/240 |
| 7,871,113 | B2 * | 1/2011 | Watanabe et al. | 292/336.3 |
| 2004/0262929 | A1 * | 12/2004 | Trickel | 292/241 |
| 2006/0038414 | A1 * | 2/2006 | Jien | 292/241 |

FOREIGN PATENT DOCUMENTS

| | | |
|---|---|---|
| NZ | 205102 | 8/1983 |
| NZ | 500423 | 10/1999 |

* cited by examiner

*Primary Examiner* — Michael P Ferguson
*Assistant Examiner* — Daniel Wiley
(74) *Attorney, Agent, or Firm* — DeLio & Peterson, LLC

(57) ABSTRACT

A pivot joint includes a first component (12) having a projecting boss form (16) and a second component (11) having an opening (25) for receiving the boss form (16). A headed fastener (32) and washer (27) engage with the boss form (16), which includes engagement elements (17) that dig into the washer (27) when the joint is assembled.

10 Claims, 3 Drawing Sheets

FIG. 5.
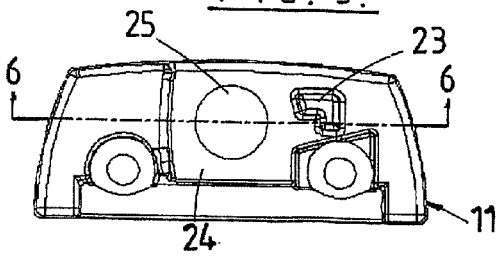
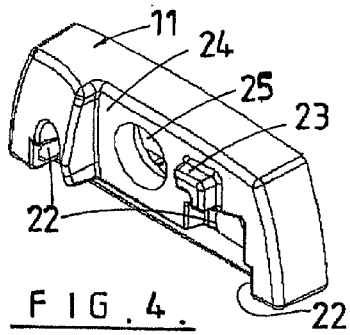
FIG. 4.
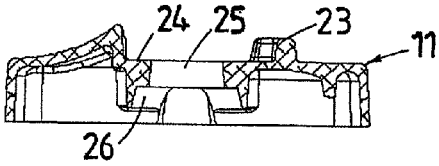
FIG. 6.
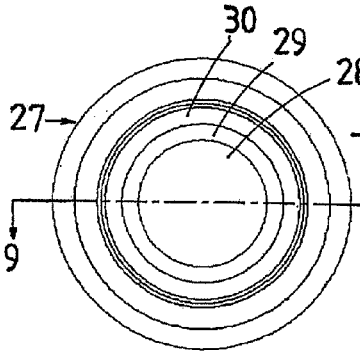
FIG. 8.
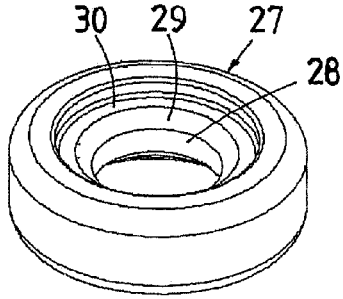
FIG. 7.
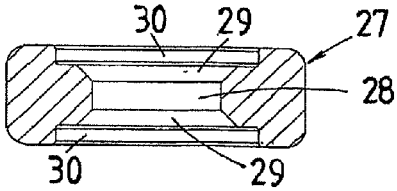
FIG. 9.

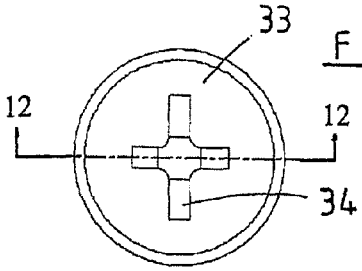
FIG. 11.
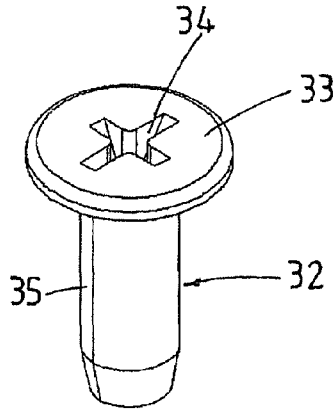
FIG. 10.
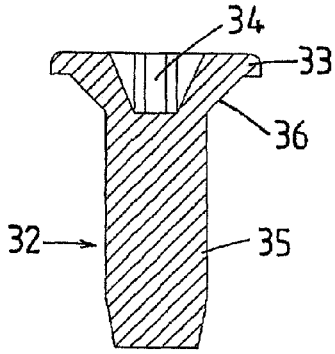
FIG. 12.
Fig. 13
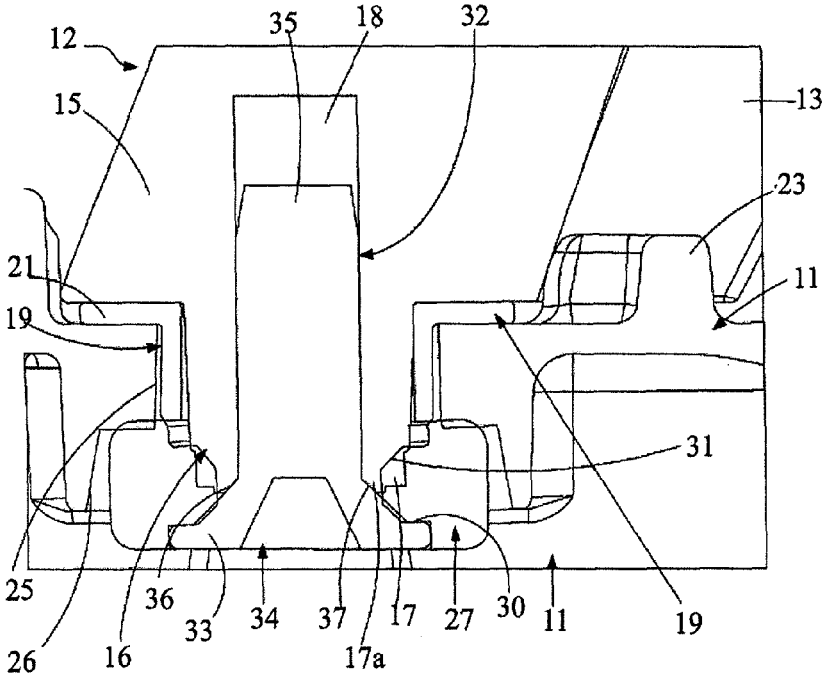

PIVOT JOINT

The present patent application is a non-provisional application claiming the benefit of International Application No. PCT/NZ2007/000177, FILED Jul. 11, 2007.

FIELD OF THE INVENTION

This invention relates to a pivot joint and more particularly a pivot joint which is intended for providing the pivot coupling of two components of an item of building hardware especially a window fastener.

BACKGROUND TO THE INVENTION

Items of building hardware are known where one component needs to be coupled by a pivot joint to another component. Such an item of hardware is a window fastener in which typically a handle is pivotally coupled to a mounting base. An example of such a window fastener is the so-called "wedgeless" fastener which is the subject of our New Zealand patent specifications 205102 and 500423.

It is a requirement of such a pivot joint that it exhibits good longevity characteristics. The window fastener will be put through many operations during its serviceable life time. Consequently, it is necessary that the joint is able to maintain its operating characteristics over many operational cycles. Also there is a requirement to achieve, in the manufacturing of such joints, a consistency of level of friction in the joints.

It is an object of the present invention to provide a pivot joint for pivot coupling of two components in an item of building hardware that exhibits enhanced endurance performance.

Manufacturers of items of hardware, especially window hardware are always striving to achieve savings in the manufacturing costs, whether such savings arise from lower manufactured costs of componentry or cost of labour associated with manufacture/assembling of the hardware. This is especially so with window fasteners where a window fastener is expected to meet operational requirements and longevity, yet at the lowest possible cost. Window fasteners are often seen as low cost items. However, this does not lessen the user demands and expectations associated with such an item of hardware.

It is therefore a further object of the present invention to provide a joint design which can contribute to lessening of the manufactured cost of an item of hardware incorporating the joint. Each object is to be read disjunctively with the object of at least providing the public with a useful choice.

SUMMARY OF THE INVENTION

In a first aspect the invention provides a pivot joint for coupling first and second components of an item of building hardware, the joint including:

a boss form projecting from the first component;

an opening in the second component in which the boss form is rotationally engaged;

a headed fastener engaged with the boss form; and a first washer engaged between the head of the headed fastener and a surface of the second component adjacent the opening;

wherein the boss form includes one or more engagement elements that dig into the first washer upon assembly of the pivot joint to couple the washer to the boss form.

BRIEF DESCRIPTION OF THE DRAWINGS

In the following more detailed description of the invention according to one broad embodiment of the invention, reference will be made to the accompanying drawings in which:

FIG. 4 is a perspective view of the mounting base of the fastener, FIG. 5 is a top plan view of the mounting base, FIG. 6 is a section view on line A-A of FIG. 5, FIG. 7 is a perspective view of a washer incorporated in the joint, FIG. 8 is a plan view of the washer, FIG. 9 is a section on line B-B of FIG. 8, FIG. 10 is a perspective of a screw incorporated in the joint, FIG. 11 is a top plan view of the screw, FIG. 12 is a section view line C-C of FIG. 11, and FIG. 13 shows, at an enlarged scale, the joint incorporating the components of FIGS. 2-12.

DETAILED DESCRIPTION

Figure 1:
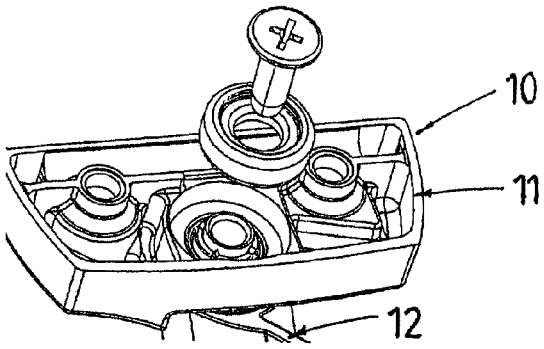
FIG. 1 is an exploded view of the pivot joint incorporating the invention and forming part of a window fastener.
Figure 2:
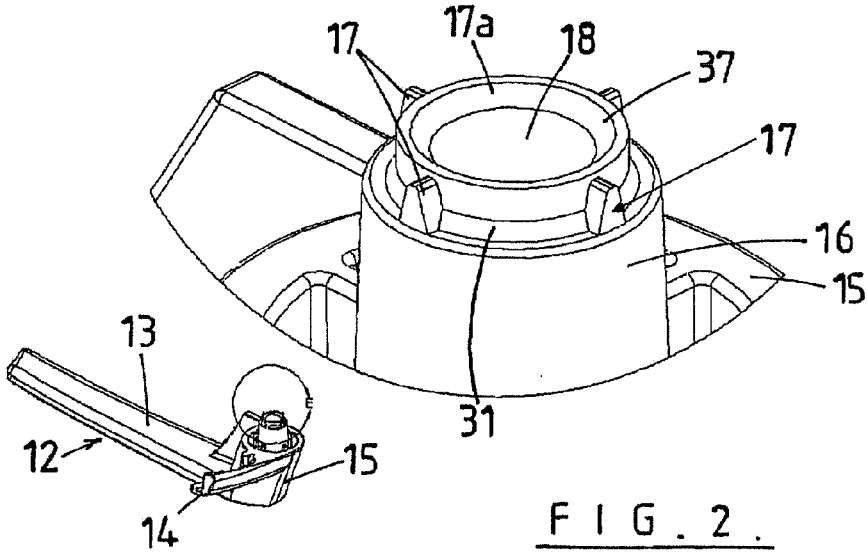
FIG. 2 is a perspective underside view of the handle of the window fastener together with an enlarged detail of the body end and associated boss of the handle.

Referring firstly to FIG. 1, there is shown a partial view of a window fastener which incorporates a mounting base 11 to which is pivotally coupled a handle 12. The handle is more fully shown in FIG. 2 and comprises a lever 13 and a nib 14, each of which is coupled to a body 15. The window fastener 10 can be of a design whereby the nib 14 is intended to engage with a wedge plate or it can be of a "wedgeless" version whereby a wedge flap is pivotally coupled to the mounting base 11 and is moved between latching and non-latching positions in response to movement of the handle 12.

The particular form of the window fastener is not important to the invention.

Projecting from the body 15 (see FIG. 2) is a boss form 16. This has formed therein an axial bore 18. An annular wall or turret 17*a* is located at the distal end of the boss form 16 and forms the mouth of the bore 18. Spaced radially about the turret 17*a* are a series of spikes 17. These spikes, as will hereinafter become apparent, are intended to grip a washer 27 (see FIGS. 7 to 9), which forms one of the components of the pivot joint.

Figure 3:
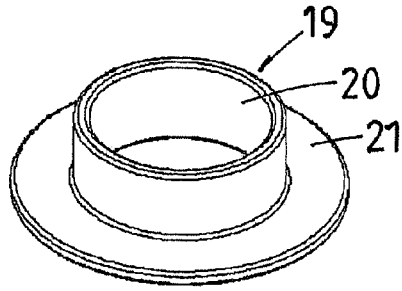
FIG. 3 is a perspective view of a "top-hat" washer incorporated in the joint.

A top-hat washer is shown in FIG. 3 and essentially consists of an annular body 20 with a flange 21 at one end. As can be seen in FIG. 13, this top-hat washer 19 engages with the boss form 16 so that the flange 21 engages against the surface of the body 15, with handle 12 and the annular wall 20 extends alongside and in the same direction as the boss form 16 projects beyond the end of the body 15. This top-hat washer 19 is made of a wear resistant material (e.g. a plastic material such as acetal) and separates the moving surfaces of the body 15 and boss form 16 from the mounting base 11.

The mounting base 11 as illustrated in the drawings, more particularly FIGS. 1 and 4-6, is a mounting base 11 intended for a wedgeless type window fastener. Therefore, on the upper surface of the mounting base 11 there are provided constructional details 22 which are designed to accommodate the hinged or pivotable wedge flap (not shown). As these do not form any part of the present invention they will not be further described herein. The purposes of details 22 can, however, be ascertained from our New Zealand patent specifications 205102 and 500423 as can also the stop element 23 which provides end stops for the handle 12.

In the upper surface 24 of the mounting base 11 there is formed an opening 25. As can be seen from FIG. 13, the opening 25 is of a size sufficient to accommodate the boss form 16 and the associated annular wall 20 of top-hat washer 19.

As is apparent from FIG. 6 there is within the mounting base 11 a counterbore 26 which is coaxial with the opening 25. This accommodates the washer 27 illustrated in FIGS. 7-9.

The washer 27 is of generally annular shape and, as can be seen from FIG. 9, is symmetrical both in the horizontal plane (which is transverse to the washer's axis) and the vertical plane (which contains the washer's axis). It is therefore non-handed and can, accordingly be incorporated in the pivot joint either way round.

The washer 27 is made of a suitable plastic material. A suitable material is Tenac-Lubricomp, which is a composition of ⅔ acetal and ⅓ polytetrafluoroethylene. This is by way of example, as it will be evident to those skilled in the art that other suitable materials could equally be used.

The washer 27 includes a central bore 28 which is sized to accommodate the diameter of the turret 17*a* at the distal end of the boss form 16. This bore 28 communicates either side with an outwardly flared transition portion 29 which in turn opens into a counterbore 30. As is evident from FIG. 9, the transition portion 29 has a sidewall which inclines outwardly from the bore 28.

As is more evident from FIG. 13, the transition of the end of the boss form 16 to the turret 17*a* includes an inclined surface 31. The slope of this inclined surface 31 is substantially commensurate with the slope of the transition section 29.

The components of the pivot joint are coupled together by way of a trilobular fastener 32 (see FIGS. 10-12). This trilobular fastener 32, which will for convenience hereinafter be referred to as screw 32, has a large washer-type head 33. This includes a conventional recess 34 for engagement with a suitably shaped tool. Extending from the head 33 is shank 35. A transition 36 in the form of an inclined wall 36 extends between the underside of the head 33 and the shank 35. The slope of this wall 36 is substantially commensurate with the slope of the transition 29 of washer 27.

It will be appreciated that, while not shown, the shank 35 is provided with a male thread form which is engageable in the bore 18. The bore 18 may be formed with a female thread form, or alternatively the screw 32 may be a self-tapping screw. Thus with the boss form 16 and associated top-hat washer 19 engaged through opening 25 in the mounting base 11, the screw 32 with washer 27 engaged thereon can be screwed into the bore 18. As is evident from FIG. 13, the boss form 16 and top hat washer 19 are engaged through opening 25 from the upper side of the mounting base 11, while screw 32 and associated washer 27 are engaged through from the underside of the mounting base 11. The washer 27 thus becomes located in the counterbore 26.

Upon the screw 32 being screwed into the opening 18 the spikes 17 engage with and grip into the material of the washer 27. This is evident from FIG. 13.

The screw 32 is screwed into bore 18 sufficiently to apply the required level of mechanical force to the washer 27 to thereby compress the washer 27 onto the base and hence create a desired level of friction in the pivot joint.

In the preferred form of the invention this level of friction is reached when the sloping transition wall 36 of the screw 32 comes into engagement with a correspondingly sloped mouth surface 37 in the turret 17*a*. Thus, uniformity of friction level is achieved by screwing the screw 32 hard down onto the surface of the mouth 37. As is indicated in FIG. 13 this creates a tight fit between the surface 36 of the screw 32 and the transition 29 of the washer 27, and contact between the surface of the washer 27 and the floor surface of the counterbore 26 in the mounting base 11.

The pivot joint according to the present invention thus, uses one completely symmetrical plastic washer in place of multiple components such as a zinc washer and flat plastic washer typically employed in known pivot joint design. Also, the screw 32 has a large head diameter in order to maintain strength. These features combined with the triangular spikes 17 digging into the plastic washer 27, so as to prevent the washer 27 from rotating other than with the boss form 16, provide a joint of significantly enhanced endurance performance over known joints used in window fasteners.

With the joint design according to the present invention, there is no need to orientate the washer as it is non-handed i.e. upside down installation is not possible. This is of benefit in a manufacturing procedure as it is no longer necessary to determine the orientation of the washer prior to installation.

With known joint designs for window fasteners it is common for a washer component to have an angular shaped part which interengages with a correspondingly angular shape feature of the boss form to ensure a mechanical coupling such that the washer component moves with the boss form. Also, it is common to use an adhesive such as Loctite® to lock the washer component in place on the boss form. Such features are not required in the present invention due to the feature of the spike 17 digging into the plastic washer 27 to achieve an automatic mechanical coupling during assembly.

The pivot joint, according to the present invention, also has one less component compared to existing joint designs thereby resulting to further economics of manufacture due to the absence of the cost of the additional component and the need to assemble this into the joint.

Finally, the present invention provides greater allowance for differences in stack height due to more elasticity in the washer 27. This leads to improved endurance of the friction established in the joint by the washer.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departure from the spirit or scope of the Applicant's general inventive concept.

What is claimed is:

1. A window fastener including a pivot joint for coupling first and second components, the window fastener including:

a first component, said first component comprising a substantially cylindrical boss protruding therefrom, wherein said boss includes one or more engagement elements on a surface thereof;

a second component, said second component having an opening therethrough, wherein said boss of said first component is inserted into said opening on a first side of said second component;

a fastener comprising a head and a shank, wherein said shank is inserted into said opening from a second side of said second component opposite said first side, and wherein said shank is received in a bore in the boss; and a first washer disposed between the head of the fastener and a surface on said second side of the second component adjacent the opening, the first washer including an inner bore, a first transition portion inclined outwards from a first end of the inner bore towards a first side of the first washer and a second transition portion opposite the first transition portion inclined outwards from a second end of the inner bore towards a second side of the first washer, the washer having an axis extending through said inner bore;

wherein the shank of said fastener is inserted through said inner bore such that said shank is substantially coaxial with said axis; and wherein when said fastener is received in the bore in said boss, said engagement elements penetrate into the first transition portion of said first washer to couple the first washer to the boss, and the head of said fastener engages with said second transition portion, thereby securing said first component and said second component in pivotable engagement relative to each other about said axis.

2. The window fastener according to claim 1 wherein the second component includes a counterbore around the opening, for receiving the first washer.

3. The window fastener according to claim 1 wherein the first transition portion is inclined outwards from the first end of the inner bore to a first counterbore and the second transition portion is inclined outwards from the second end of the inner bore to a second counterbore.

4. The window fastener according to claim 3 wherein the fastener includes a transition between its head and its shank, wherein an incline of the transition substantially matches the incline of at least one of the first washer's transition portions, the transition lying against the at least one transition portion in an assembled pivot joint.

5. The window fastener according to claim 3 wherein the inclined surface of the boss substantially matches the incline of at least one of the first washer's transition portions, the inclined surface lying against the at least one transition portion in an assembled pivot joint.

6. The window fastener according to claim 1 wherein the first washer is formed from plastic.

7. The window fastener according to claim 6 wherein the first washer is formed from a material including acetal and polytetrafluoroethylene.

8. The window fastener according to claim 7 wherein the material includes about ⅔ acetal and ⅓ polytetrafluoroethylene.

9. The window fastener according to claim 1 further including a second washer configured to engage between an inside surface of the opening and an outside surface of the boss.

10. The window fastener according to claim 9 wherein the second washer is a top-hat washer with an annular flange which engages with a surface of the second component adjacent the opening on an opposite side of the second component to the first washer.

* * * * *